US005938052A

United States Patent [19]

Miyano et al.

[11] Patent Number: 5,938,052

[45] Date of Patent: Aug. 17, 1999

[54] ROPE STEADYING CONTROL METHOD AND APPARATUS FOR CRANE OR THE LIKE

[75] Inventors: Toshio Miyano; Takayuki Yamakawa; Tetsuo Kawano, all of Fukuoka, Japan; Richard L. Pratt, Cincinnati, Ohio; Frederick C. Lach, Menomonee Falls, Wis.

[73] Assignee: Kabushiki Kaisha Yaskawa Denki, Fukuoka, Japan

[21] Appl. No.: 08/750,584

[22] PCT Filed: Apr. 25, 1996

[86] PCT No.: PCT/JP96/01132

§ 371 Date: May 15, 1997

§ 102(e) Date: May 15, 1997

[87] PCT Pub. No.: WO96/33943

PCT Pub. Date: Oct. 31, 1996

[30] Foreign Application Priority Data

Apr. 26, 1995 [JP] Japan ..... 7-102643

[51] Int. Cl.[6] ..... B66C 13/06

[52] U.S. Cl. ..... 212/275; 212/270

[58] Field of Search ..... 212/275, 270

[56] References Cited

U.S. PATENT DOCUMENTS

| | | | |
|---|---|---|---|
| 4,997,095 | 3/1991 | Jones et al. | 212/275 |
| 5,443,566 | 8/1995 | Rushmer et al. | 212/275 |
| 5,495,955 | 3/1996 | Shibata | 212/275 |

FOREIGN PATENT DOCUMENTS

| | | |
|---|---|---|
| 41-52500 | 8/1966 | Japan . |
| 59-203093 | 5/1983 | Japan . |
| 3-32388 | 1/1991 | Japan . |
| 4-185823 | 6/1992 | Japan . |

*Primary Examiner*—Thomas J. Brahan
*Attorney, Agent, or Firm*—Jordan and Hamburg LLP

[57] ABSTRACT

An object of this invention is to provide a high performance and low cost crane rope steadying control method and apparatus for which mechanical or optical swing angle detecting means are not necessary.

The invention provides a rope steadying control method for a crane or the like having a trolley driving apparatus for causing a load suspended by a rope of a crane or the like to travel, wherein swinging of a load suspended by a rope is stopped by calculating a swing load signal $I_{2W}^*$ proportional to the rope swing angle and the load by computationally estimating a motor torque estimate signal $\tau_M^*$ not including load torque fluctuations caused by swinging of the rope on the basis of gain coefficients and equivalent time constants of the control system and the drive system, and comparing this estimate signal $\tau_M^*$ with an actual load torque $\tau_M$ and negatively feeding back to a trolley speed command $N_S$ of the trolley driving apparatus (1) a speed signal $N_W$ produced by carrying out phase lead/lag compensation on the difference between a swing angle detection estimated value $\theta_1^*$ proportional to this swing load signal and a swing angle set value $\eta_S$.

12 Claims, 6 Drawing Sheets

ROPE STEADYING CONTROL METHOD AND APPARATUS FOR CRANE OR THE LIKE

BACKGROUND OF THE INVENTION

This invention relates to a control method and apparatus for suppressing the swing of a load suspended on a rope, for example a load suspended from a trolley of an overhead traveling crane, a container suspended from a trolley of a container crane or a container carrier, or a grab bucket on a grab bucket crane or an unloader for loading and unloading bulk material, during travel of the grab bucket, or the like.

As is commonly known, methods for suppressing the swing of a suspended load during acceleration, deceleration or steady travel can be generally divided into mechanical steadying methods and electronic steadying methods.

Mechanical steadying methods include methods for stopping swinging by providing, for example, a guide mast on the trolley itself, or by focusing on the structure of a container crane or the container itself, or by using special rope arrangements and rope tension devices or hydraulic cylinders capable of suppressing the swing.

Electronic steadying methods include methods wherein the steadying control is carried out by detecting the swing angle or the swing speed of the suspended load and feeding this back to the drive system, or by computing and ordering a speed pattern with which swing can be eliminated at the end of acceleration (for example the crane rope steadying control method of Japanese Patent Publication No. Sho 45-4020).

This electronic steadying control includes a closed loop type control wherein steadying is carried out by detecting the swing angle of the suspended load and feeding this back to the drive system through a suitable compensating element, and an open loop type control wherein, on the basis of solutions of equations of motion pertaining to the suspended load, swing angles and swing speeds during acceleration and deceleration are predicted, and acceleration and deceleration rates and times by which steadying can be achieved are ordered (for example the suspended type crane rope steadying control apparatus of Unexamined Japanese Utility Model Publication No. Sho 57-158670).

With a conventional method, as disclosed in Japanese Patent Publication No. Sho 45-4020, swing angle detecting means are fundamentally necessary. In this method, the swing angle of the rope is mechanically detected but, because the rope moves during hoisting and lowering, the structure of the linkage device must fulfill the conflicting requirements of certain linkages to the rope and slidability with respect thereto, and the resulting design has inevitably been complicated and lacking in reliability.

To solve this problem, an optical swing angle detecting system using a light source, a camera and an image processing device has recently been proposed.

Although this system has no mechanical linkage with the moving rope, deterioration due to dust is a concern because of its optical nature. Furthermore, the accurate alignment of the light source and camera, and processing to compute the swing angle from an image, incur excessive costs. Also, for reasons relating to crane structure, the camera is generally mounted in the vicinity of the hoisting winch of the trolley, and requires installation space there. Also, supposing now that the trolley acceleration is 0.5 m/sec$^2$, even considering the maximum swing angle, its value is quite small, at 0.102 rad, and accurate alignment of the camera and the light source is necessary from the point of view of swing angle detection precision. Also necessary is accurate camera control. Thus, the detecting apparatus is unavoidably complicated and delicate.

To solve these kinds of problems, swing angle models and swing angle observers for estimating swing angles by calculation from motor speed, trolley speed and rope length or the like, without using a swing angle detecting apparatus, have also been studied. Unfortunately, because they are quite complex, make large errors, and cannot handle cases where there is an initial swing or outside disturbance, they have not achieved practical applicability.

SUMMARY OF THE INVENTION

Accordingly, an object of this invention is to develop a load torque observer which does not necessitate mechanical or optical swing angle detecting means, and which is based on a completely different principle from conventional swing angle models and observers, thereby providing high performance and low cost steadying control method and apparatus.

To achieve the above-mentioned object and other objects, the rope steadying control method of this invention for a crane or the like having a trolley drive apparatus for transporting a load suspended by the crane rope or the like, consists of stopping the swinging of a load suspended by a rope by calculating a swing load signal $I_{2W}^*$ proportional to the rope swing angle and the load by computationally estimating a motor torque estimate signal $\tau_M^*$ not including load torque fluctuations caused by rope swing on the basis of gain coefficients, and equivalent time constants of the control system and the drive system, and comparing this estimate signal $\tau_M^*$ with an actual load torque $\tau_M$, and negatively feeding back a signal $N_W$ obtained by carrying out phase lead/lag compensation on the difference between a swing angle detection estimated value $\theta_1^*$ proportional to this swing load signal and a swing angle set value $\theta_S$ to a trolley drive apparatus trolley speed command $N_S$.

Also, a rope steadying control apparatus of the invention for a crane or the like, comprising a trolley driving apparatus for causing a load suspended by a crane rope or the like to travel, having a torque control for controlling a torque produced by the driving apparatus on the basis of a speed command, a speed control device for automatically controlling the speed of the driving apparatus, and control devices for controlling the speed and position of the trolley, comprises a torque model for computationally estimating a motor torque estimate signal, not including load torque fluctuations caused by swinging of the rope, on the basis of gain coefficients and equivalent time constants of the control system and the drive system, a means for converting on the basis of the output of the torque control device of the driving apparatus into a torque signal $\tau_M^*$, a means for detecting a signal $I_{2W}^*$ corresponding to a swing load signal proportional to the rope swing angle and the load by comparing the output signal $\tau_M^*$ of the torque model and the torque signal $\tau_M$, a means for converting the signal $I_{2W}^*$ into a swing angle estimate signal $\theta_1^*$, and a phase lead/lag circuit for negatively feeding back to a speed command $N_S$ a speed signal $N_W$ produced by carrying out phase lead/lag compensation on the difference between the swing angle estimate signal $\theta_1^*$ and a swing angle set value $\theta_S$.

In this method and apparatus, to protect the steadying performance from failure due to variations in rope length, the loop gain of the steadying control is adjusted to a value proportional to the rope length to the power of ½.

Also, to protect the steadying performance from failure due to reduction in the suspended load, the loop gain of the steadying control is designed to increase in inverse proportion to reduction in the load.

This invention focuses on the fact that the load swing torque component of the trolley load is large and that its size is proportional to the load swing angle, and provides steadying control by feeding this component back to the drive system by means of an electronic signal processing the driving apparatus. Because the invention dispenses with the need for a complicated mechanical or expensive optical swing angle detecting apparatus and, compared to a conventional swing angle observer, is based on the principle of obtaining the swing angle by detecting a swing load directly proportional to the swing angle, the invention is essentially superior in accuracy and reliability, and can also handle initial swing and outside disturbances.

DETAILED DESCRIPTION OF THE INVENTION

The invention will now be described in detail with reference to the accompanying FIGS. 1 through 6 and Table 1, illustrating a specific preferred embodiment.

Figure 1:
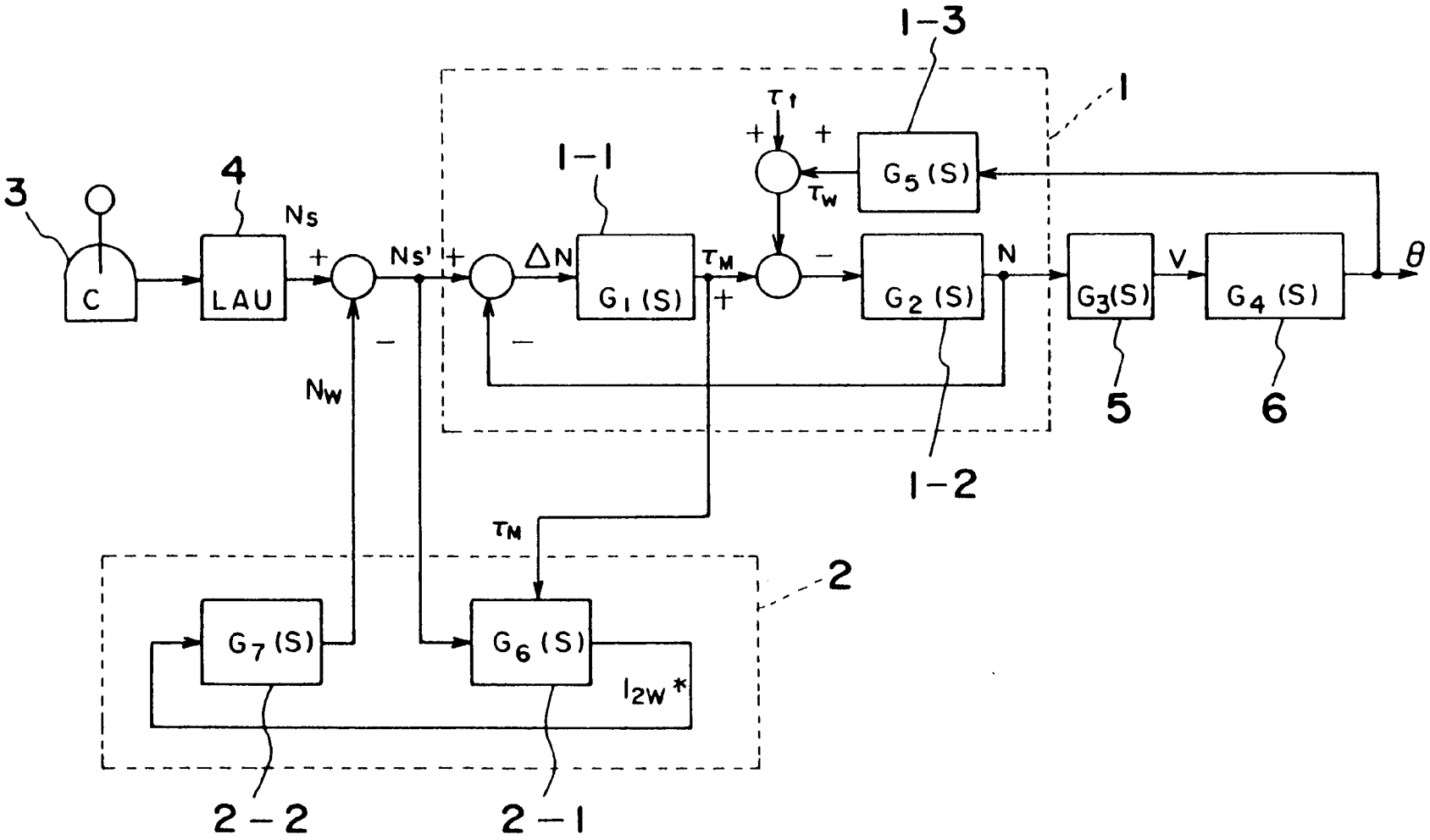
FIG. 1 is a block diagram showing the overall construction of a specific preferred embodiment of the invention.

FIG. 1 is a block diagram illustrating the principle of the invention. In FIG. 1, a trolley driving apparatus 1 comprises a torque control device 1-1 and a motor and trolley driving system 1-2. A speed N, which is the output of the trolley driving system 1-2, is fed back into the input side of the torque control device 1-1, whereby a known automatic speed control device is made. A torque transmission coefficient 1-3 transmits a torque arising as a result of the swinging of a load (hereinafter called 'swing load torque') to the trolley driving system 1-2 (as will be further discussed later).

Reference number 2 in FIG. 1 denotes a steadying control apparatus of the invention made up of a load torque observer 2-1 and a steadying controller 2-2. Reference number 3 denotes a speed commander connected to a speed command handle for supplying a speed command to an acceleration regulator 4 (for example, a linear commander), and the acceleration regulator 4 outputs a regulated speed command $N_S$. Reference number 5 denotes an element for converting the motor speed N into a trolley velocity v. Reference number 6 denotes a dynamic model of trolley swing having the trolley velocity v as its input and outputting a trolley swing angle θ.

Reference numerals $G_1(S)$ to $G_7(S)$ in the blocks each denote transmission coefficients expressing the transmission characteristics of the respective device or element.

Figure 2:
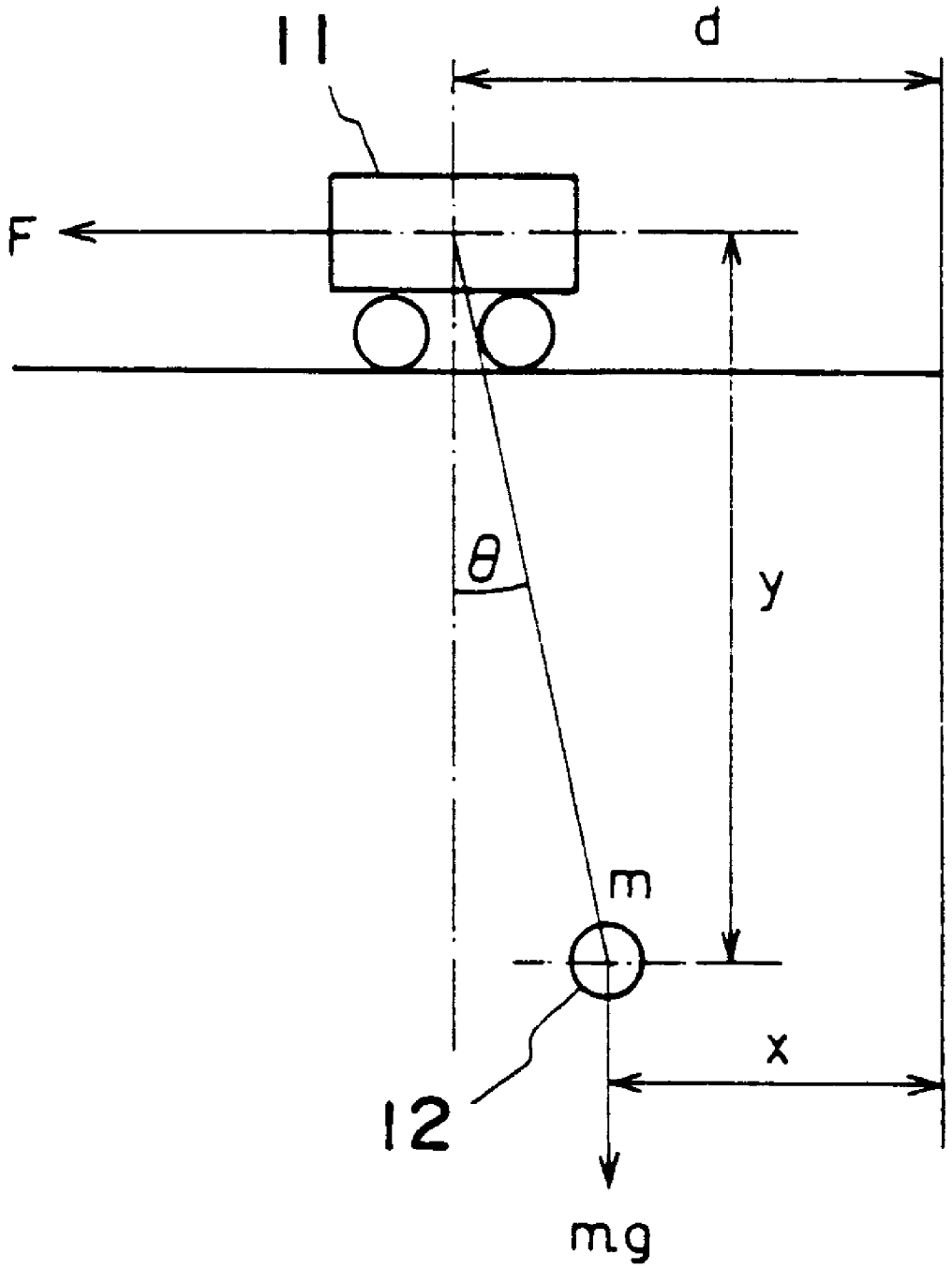
FIG. 2 is a view illustrating a dynamic model of swing in a general trolley.

A dynamic model of swing of a trolley can generally be expressed as shown in FIG. 2. In FIG. 2, 11 is a trolley and 12 is a load.

From FIG. 2, the following relational expressions can be obtained.

$$m\cdot d^2y/dt^2=m\cdot g-T\cdot\cos\theta \quad (1)$$

$$m\cdot d^2x/dt^2=T\cdot\cos\theta \quad (2)$$

$$y=h\cdot\cos\theta \quad (3)$$

$$x=d-h\cdot\sin\theta \quad (4)$$

where:

d: horizontal positional displacement of trolley from a fixed point $d^2x/dt^2$, $d^2y/dt^2$: trolley acceleration F: trolley acceleration force g: acceleration due to gravity h: length of hoisting rope m: mass of load M: mass of trolley T: tension in hoisting rope x: horizontal positional displacement of load y: vertical positional displacement of load from trolley θ: swing angle of load from the vertical Substituting Exps. (3) and (4) into Exps. (1) and (2) and rearranging, the following expressions can be obtained:

$$d^2\theta/dt^2=(1/h)\cdot((d^2(d)/dt^2)\cos\theta-g\cdot\sin\theta-2\cdot(dh/dt)\cdot(d\theta/dt)) \quad (5)$$

$$d^2h/dt^2=g\cdot\cos\theta+(d^2(d)/dt^2)\cdot\sin\theta+h\cdot(d\theta/dt)^{2-}T/m \quad (6)$$

With respect to acceleration of the trolley, the following expression holds:

$$M\cdot d^2(d)/dt^2=F-T\cdot\sin\theta \quad (7)$$

Here, considering a case wherein the hook height is constant, Exp. (5) becomes:

$$d^2\theta/dt^2=(1/h)\cdot(f\cos\theta-g\cdot\sin\theta) \quad (8)$$

Here, f: trolley acceleration=$d^2(d)/dt^2$

Also, in Exp. (8), the swing angle θ is extremely small, and therefore considering a case where it is regarded that cos θ=1.0 and sin θ=θ, the following expression is obtained:

$$d^2\theta/dt^2=(1/h)\cdot(f-g\cdot\theta) \quad (9)$$

By Laplace transforming this, Exp. 10 is obtained:

$$\theta(s)/v(s)=(1/h)\cdot(\tau^2s/(1+\tau2s(1+\tau^2s^2) \quad (10)$$

Here, v(s): trolley velocity=d(d)/dt $$\tau=(h/g)^{1/2}$$

Here, newly expressing the hoisting rope length h as L, by writing:

$$\omega=(g/L)^{1/2}(\sec^{-1}) \quad (11)$$

Exp. (10) can be expressed as the following Exp. (12):

$$\theta(s)/v(s)=(L/g)\cdot\{\omega^2s/(s^2+\omega^2)\} \quad (12)$$

where:

L: hoisting rope length(m)

g: acceleration due to gravity=9.8 m/sec$^2$ v: trolley velocity (m/sec) θ: swing angle (rad)

That is, $G_4$ in FIG. 1 is given by Exp. (12).

Next, the acceleration force of the trolley arising due to swinging will be obtained.

This acceleration force is the term T·sin θ of Exp. (7). The rope tension T of this term is the sum of a gravitational force component and a centripetal force due to circular motion of the load, but since the latter is small compared to the former, the term can be approximated to the former component.

Therefore, $$T=m\cdot g\cdot\cos\theta \tag{13}$$

That is, the acceleration force $f_s$ arising due to swinging of the load, if the swing angle is small, is expressed:

$$f_s=m\cdot g\cdot\cos\theta\cdot\sin\theta-m\cdot g\cdot\theta \tag{14}$$

Therefore, the transmission coefficient of this part is:

$$fs(s)/\theta(s)=m\cdot g \tag{15}$$

Where:

fs: trolley swinging acceleration force (N)

m: mass of load (Kg)

Therefore, G5 is given by the following expression obtained by multiplying the swinging acceleration force fs of Exp. 15 by a torque coefficient converting to the motor shaft:

$$\tau_W(s)/\theta(s)=K_W\cdot m\cdot g \tag{16}$$

Where:

$K_W$: torque converting coefficient (Kg·m/N)

$\tau_W$: motor shaft converted swing load torque (Kg·m)

In FIG. 1 the motor and trolley drive system transmission coefficient $G_2$ shown by block 1-2 is a transmission coefficient having as an input an acceleration torque $\tau_a$ which is the algebraic sum of the motor torque $\tau_M$ and [trolley friction torque $\tau_t$+swing load torque $\tau_W$] and having as an output a motor speed, and can be expressed by the following known expression:

$$N(s)/\tau_a(s)=375/(GD^2\cdot s) \tag{17}$$

Where:

N(s): motor speed (rpm)

$\tau_a$: acceleration torque (Kg·m)

$\tau_t$: trolley friction torque (Kg·m)

$GD^2$: motor $GD^2$+motor shaft converted trolley $GD^2$ (Kg·$m^2$)

s: Laplace operator (=d/dt)

Next, the transmission coefficient $G_1$ of the torque control device 1-1, for example when a vector control invertor or the like is applied, can be approximated to a first-order lag having a small lag time constant. That is, $$\tau_M(s)/\Delta N(s)=K_P/(1+T_a's) \tag{18}$$

Where:

$\tau_M(s)$: motor torque (Kg·m)

ΔN: speed difference (rpm)=$N_s'(s)-N_s$ $K_P$: speed control gain (Kg·m/rpm)

$T_a'$: equivalent torque time constant (sec)

Figure 3:
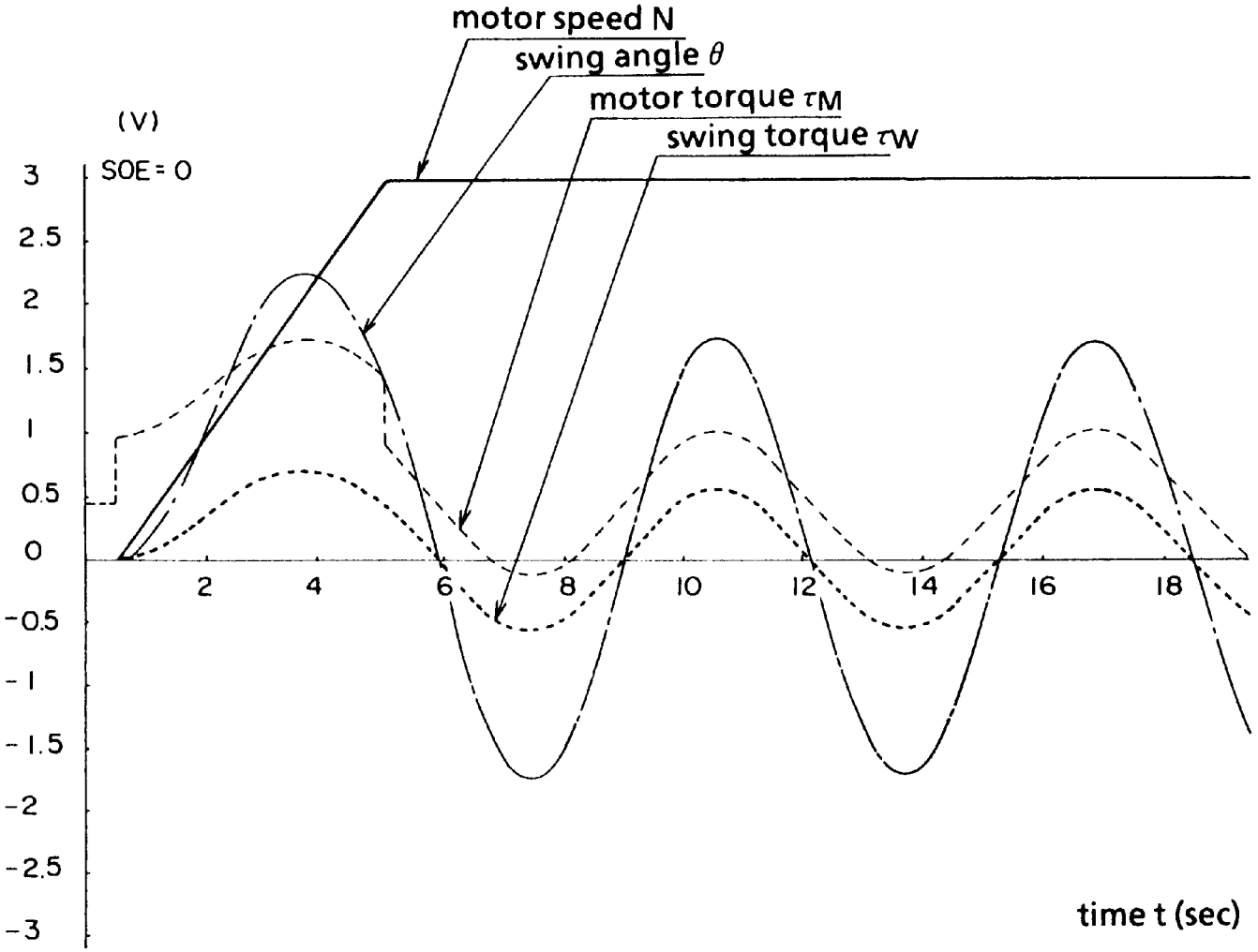
FIG. 3 is a graph obtained by simulation of load swing angle response in a construction of a preferred embodiment of the invention.

Here, to clarify the usefulness of the automatic steadying control apparatus of this invention, using the trolley drive system transmission coefficients established in the above description, trolley swing in a case where the automatic steadying control apparatus of the invention is not used will be described. FIG. 3 is a graph obtained by excluding the steadying control apparatus 2 from the construction of the preferred embodiment of the invention shown in FIG. 1 and simulating the load swing angle response in a case where the motor is accelerated for 4.5 seconds. As shown in the graph, even after acceleration ends there is significant residual swinging, and it can be seen that this is almost undamped. Therefore, when travel with minimal swinging is required or when positioning of the suspended load is required, the operator must manually carry out a steadying maneuver.

However, this maneuver requires considerable skill and, in many cases, loading and unloading efficiency falls significantly.

Next, details of the steadying control apparatus 2 of the invention will be described with reference to FIG. 4.

Figure 4:
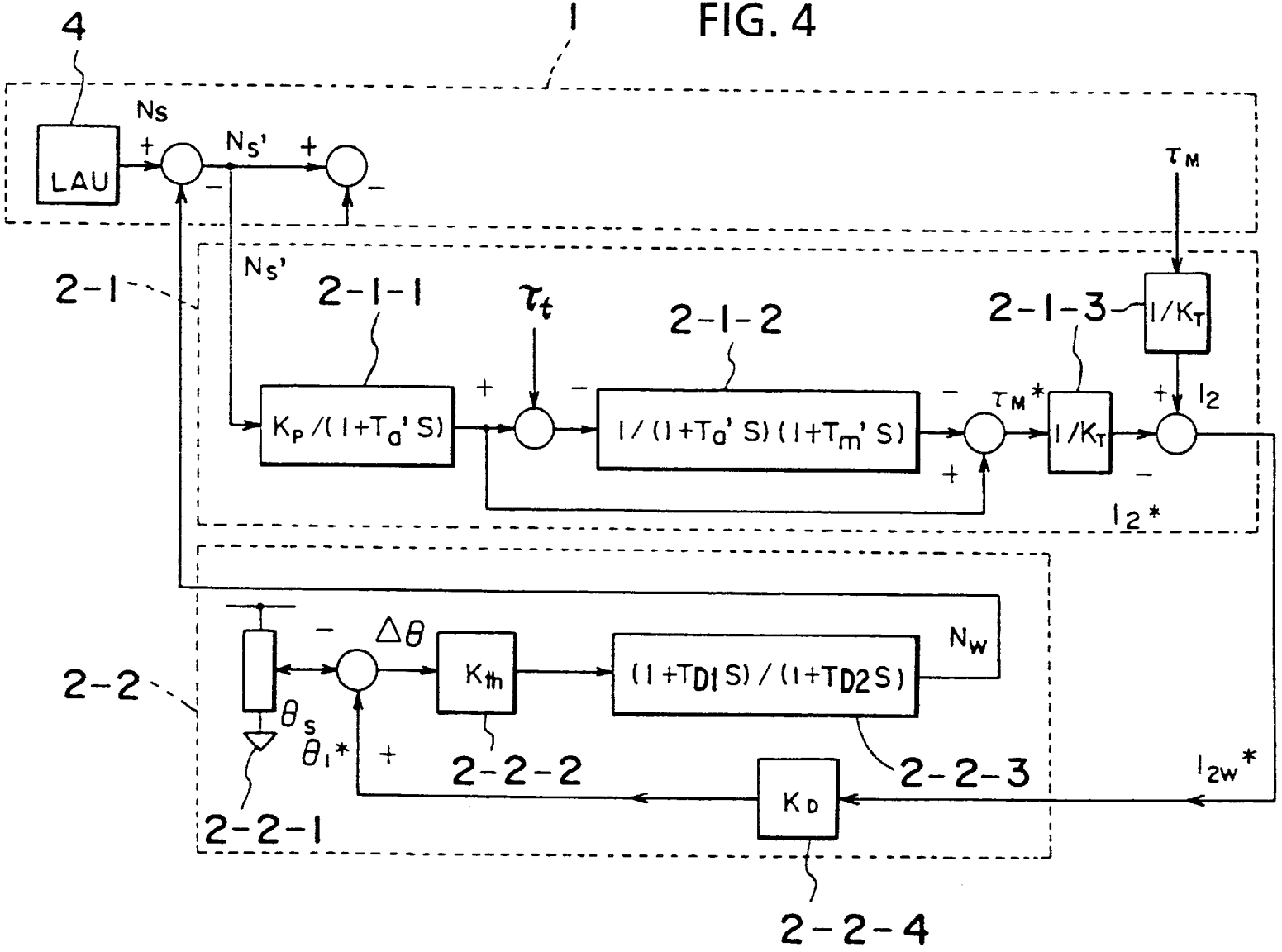
FIG. 4 is a block diagram showing details of a steadying control apparatus of the invention.

The load torque observer 2-1 of FIG. 1 is shown in detail in the block 2-1 of FIG. 4. The load torque observer 2-1 is constructed to estimate a swing load by making a torque model 2-1-2 of the kind shown for estimating a motor torque, not including swing load torque, and comparing this output $\tau_M$* with the output $\tau_M$ of the torque control device 1-1 of FIG. 1.

With a driving apparatus of which a torque command and a produced torque are linearized, as with a vector control inverter drive, as mentioned above, the transmission coefficients from the speed difference to the motor produced torque can be approximated to a first-order lag with an extremely small time constant.

Therefore, if the estimated value of motor torque, not including swing load torque, is written $\tau_M$*, using Exps. (17) and (18), this value can be expressed by a block diagram, and construction thereof like the first-order lag element 2-1-1 and the torque model 2-1-2 of FIG. 4.

That is, $$\tau_M^*(s)=Ns'(s)\times[K_P/(1+T_a's)].(1-G_6'(s))-t_t(s)\times(G_6'(s)) \tag{19}$$

Where:

Tm': compensated mechanical time constant (sec)=$(T_a'+T_m)/(1+K_p)$ $T_m$: mechanical time constant (sec)=$GD^2/375$ $t_t$: trolley friction torque (Kg·m)

$G_6'(S)$:=$1/(1+T_m's)(1+T_a's)$

The motor torque estimate value $\tau_M$* can be converted into a torque current estimated value $I_2$* by multiplying it by the reciprocal of the torque constant $K_T$, denoted by 2-1-3.

Similarly, the output $\tau_M$ of the torque control device 1-1 in the trolley driving apparatus of FIG. 1 also can be converted to an actual torque current $I_2$ by multiplying it by the reciprocal of $K_T$.

Therefore, an estimate value $I_{2W}$* of swing load current, as shown in 2-1 of FIG. 4, is expressed:

$$I_{2W}^*=I_2-I_2^*=(1/K_T)\ (\tau_M-\tau_M^*) \tag{20}$$

Where:

$K_T$: torque constant (A/Kg·m)

$I_{2W}$*: estimated value of swing load current (A)

$I_2$: actual torque current (A)

In this way it is possible to detect a swing load current proportional to the swing angle of the suspended load and to the suspended load without using mechanical or optical swing angle detecting means.

Next, the steadying controller of the invention will be described.

The block 2-2 in FIG. 4 shows the details of the block 2-2 of the preferred embodiment in FIG. 1, and in this block 2-2 the reference numeral 2-2-1 is a swing angle setter, 2-2-2 a swing angle error amplifier, 2-2-3 a phase lead/lag compensator and 2-2-4 a [swing angle/swing current] convertor.

The swing angle of the suspended load is detected as the swing current estimated value $I_{2w}$*, multiplied by the coefficient $K_D$ and thereby converted into a swing angle detection estimated value $\theta_1$*. $\theta_1$* is compared with a set value $\theta_s$ of the swing angle setter 2-2-1 and the error $\Delta\theta$ therebetween is multiplied by $K_{th}$ and passed through the phase lead/lag compensator 2-2-3 and becomes a feedback signal $N_W$ of a steadying control circuit outside the trolley automatic speed control circuit.

That is, the actual trolley speed command is the difference $N_s'$ between the output $N_s$ of the acceleration regulator 4 of FIG. 1 and the above-mentioned feedback signal $N_W$.

Therefore, if the set value of the swing angle setter is set to zero and $K_{th}$, $K_D$, $T_{D1}$, $T_{D2}$ are suitably set, control making the swing angle detection estimated value $\theta_1$* zero, i.e. steadying control, is possible.

In this case, as a stabilizing means for this system, it is possible to apply a known analysis method using a Bode diagram for example, and $K_{th}$, $K_D$, $T_{D1}$, $T_{D2}$ whereby a predetermined response can be set.

Because the equivalent torque time constant $T_a'$ in the steadying control apparatus described above with reference to FIG. 4 is small compared to the compensated mechanical time, constant $T_m'$, $G_6'$ can be approximated to a linear expression and the actual system can be simplified.

The above is a detailed description in theory of the invention based on a preferred embodiment.

However, in practicing the invention, it is necessary to solve the following three problems:

The first problem is that of finding a relationship between steadying control gain and rope length for obtaining good steadying performance even when the rope length changes.

The second problem is that of finding a countermeasure to steadying control loop gain failure and to the control performance consequently deteriorating when the suspended load decreases.

The third problem, in connection with the load observer being directed by comparing a motor torque model not including swing load and an actual torque current, is related to performance deterioration occurring when there is an error between the model and the actual machine.

The first problem arises from the fact that the value of $\omega$ in Exp. (12) varies with the rope length.

For example, when the rope length is 19.6 m, 9.8 m, 4.9 m, from Exp. (11) $\omega$ is 0.707 $sec^{-1}$, 1.0 $sec^{-1}$, 1.414 $sec^{-1}$, and the characteristic root of Exp. (12) changes with the reciprocal of the square root of the rope length. When it is supposed that $K_D \times K_{th}$, has been set to obtain a good response at a rope length of 4.9 m, with a rope length of 9.8 m this value must be made approximately $\sqrt{2}\times$ and with a rope length of 19.8 m it must be made $2\times$.

Figure 5:
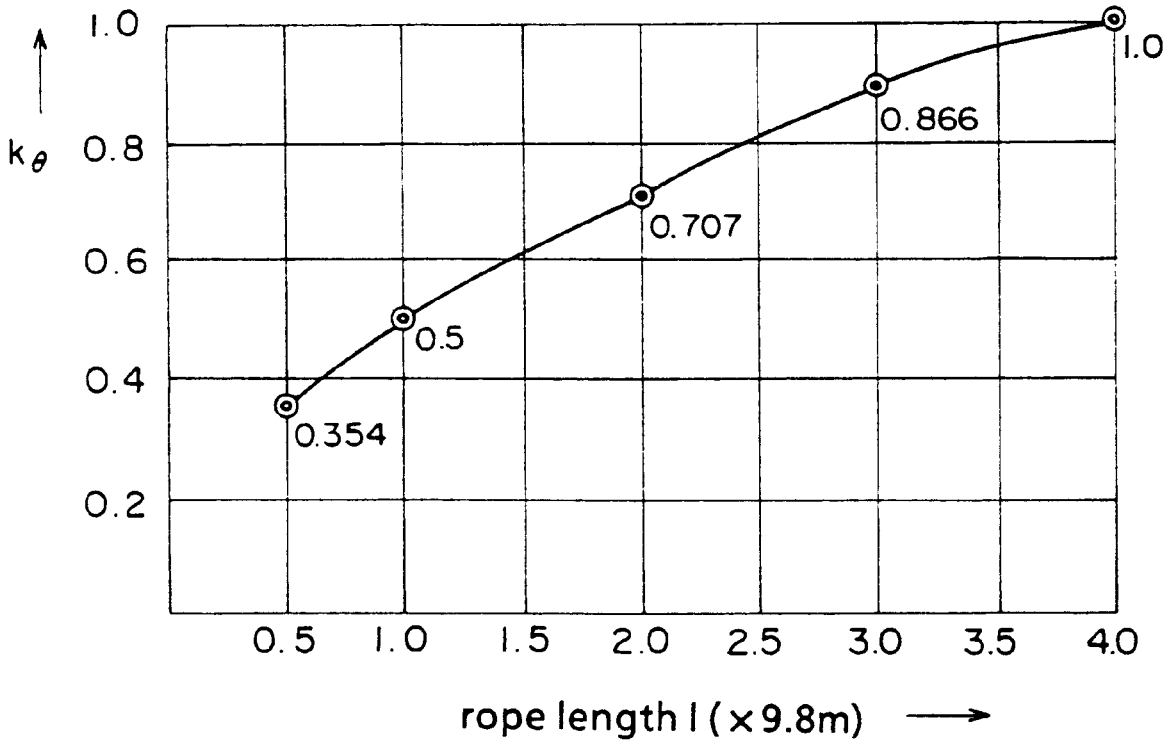
FIG. 5 is a graph showing an example of a relationship between rope length and optimum control gain obtained by simulation.

FIG. 5 is an example of a relationship between rope length and optimum control gain obtained by simulation. In FIG. 5, $K_D$ is kept constant and the optimum values of Kth, are shown. From the graph it can be seen that this value is substantially proportional to the rope length to the power of ½.

Thus, this problem can be solved and good steadying performance can be ensured by adjusting the control gain in accordance to the rope length.

The second problem arises from the fact that, when the suspended load is small, $I_{2W}$* is correspondingly small, and as a result the same signal as when the swing angle has decreased is fed to the steadying control system.

However, a load lifted in a hoisting operation does not normally change during travel. That is, by measuring the size of the load during the hoisting operation it is possible to compensate with $K_D$. Considering the stability of the overall system, $K_D$ must increase in inverse proportion to the reduction in the load.

Now, in the method of this invention, as shown in FIG. 4, because the produced torque of an actual motor is used to make a swing load observation, there is the restriction that the addition of this steadying control loop must not cause the torque inside the speed control apparatus or the current control minor loop to oscillate.

To solve this problem, it is possible to obtain by calculation a necessary lag compensating time constant $T_{D2}$ and a lead time constant $T_{D1}$ with respect to loop again using a known Bode diagram. In this preferred embodiment, by Bode diagram analysis and by calculating change in motor load accompanying variation in the suspended load, optimum gains in steadying were obtained and confirm by simulation.

Table 1 shows calculation examples for this kind of constant in the preferred embodiment.

TABLE 1

| Rope Length | | | Phase Lag Time | Steadying Gain Constant | | | |
|---|---|---|---|---|---|---|---|
| L (m) | $\omega$ ($sec^{-1}$) | Detection Gain | Constant $T_D$ | 100% load | 50% load | 25% load | 12.5% load |
| 0.5 × g | 1.414 | 1.5 | 0.353 | 0.364 | 0.676 | 1.243 | 2.13 |
| 1.0 × g | 1.0 | 1.5 | 0.5 | 0.5 | 0.955 | 1.755 | 3.02 |
| 2.0 × g | 0.707 | 1.5 | 0.707 | 0.707 | 1.35 | 2.482 | 4.26 |
| 3.0 × g | 0.577 | 1.5 | 0.866 | 0.866 | 1.65 | 3.04 | 5.22 |
| 4.0 × g | 0.5 | 1.5 | 1.0 | 1.0 | 1.91 | 3.51 | 6.03 |

In this way, it is possible to set optimum $T_{D2}$ and $K_{th}$ with respect to variations in the rope length and the suspended load.

The third problem is unlikely to constitute a problem in practice because constants such as control gains design values of the machine can be applied, because for time constants it is possible to measure actual values before actual operation, and because they can also be ascertained by no-load operation test trials. If necessary, a known constant auto-tuning technique can also be used.

A matter that should be considered is variation in the set value $T_f$ of the friction torque, but in this case auto-tuning on the basis of no-load trials is also possible. This setting error becomes a speed command error after steadying ends, but does not affect the steadying performance. Also, in positioning control, normally, because the position control loop is placed outside the speed control loop, variation in the speed command, caused by a setting error of this friction torque setting, does not become a positioning error.

Figure 6:
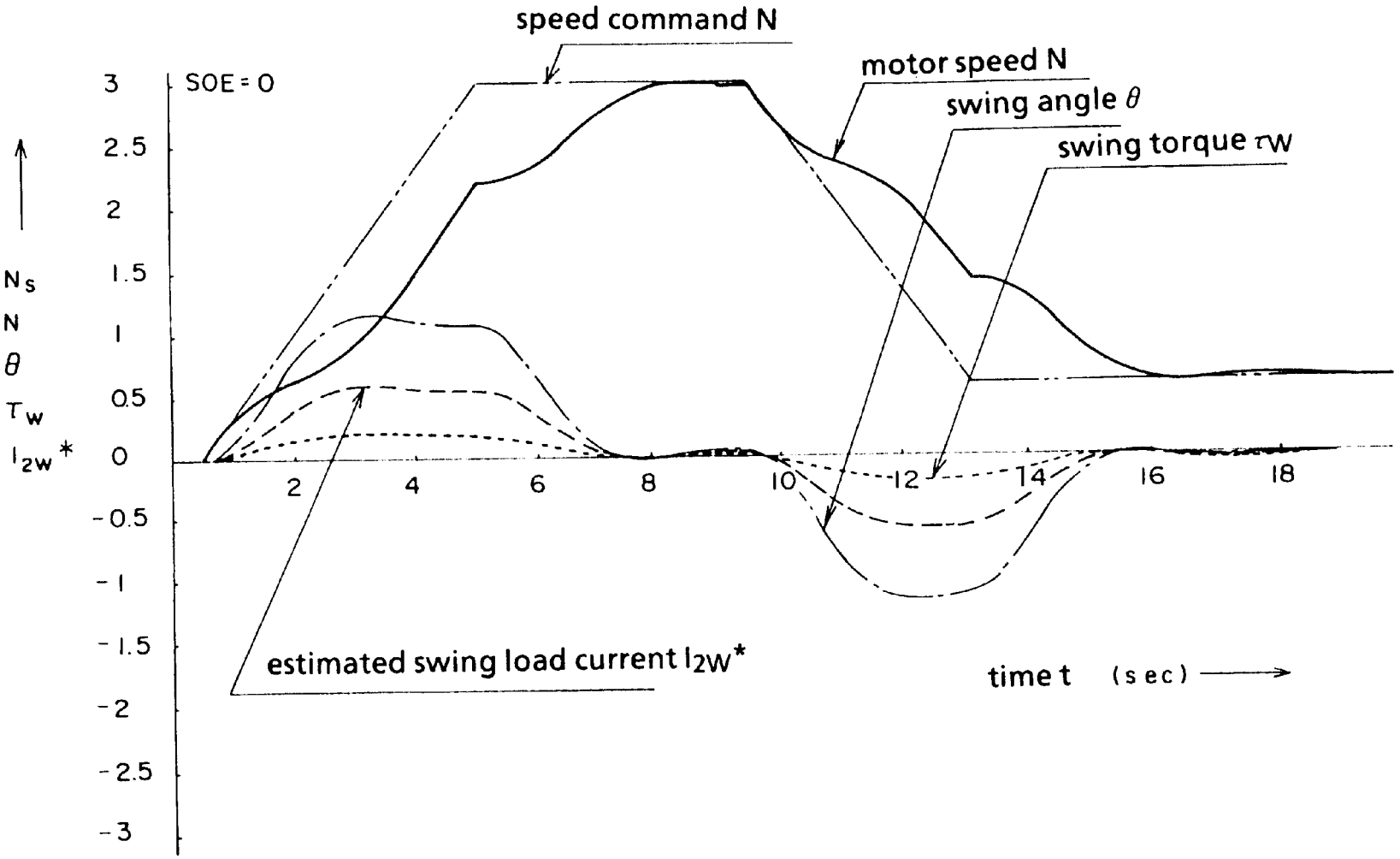
FIG. 6 is a graph showing simulated steadying performance of a preferred embodiment of the invention.

FIG. 6 shows the steadying performance of this preferred embodiment of the invention obtained by simulation.

From FIG. 6 it can be seen that swinging of the suspended load is almost eliminated on completion of acceleration and deceleration. Also, comparing this with the characteristics of FIG. 3, it can be seen that, compared to a case where the steadying control of the invention is not used, the maximum swing angle during acceleration is also suppressed to about 52% (1.15/2.2=0.523).

Because this invention dispenses with the need for a complicated mechanical or expensive optical swing angle detecting apparatus and, compared to a conventional swing angle observer, is based on the principle of obtaining the swing angle by detecting a swing load directly proportional to the swing angle, the invention is essentially superior in accuracy and reliability and also can handle initial swing and outside disturbances. Therefore, it is possible to provide a cheap and high performance steadying control apparatus.

INDUSTRIAL APPLICABILITY

This invention can be used for the suppression of swinging during travel of a load suspended from a trolley of an overhead traveling crane or the like, a container suspended from a trolley of a container crane or a container carrier, or a grab bucket of a grab bucket crane or unloader or the like for loading and unloading bulk material.

We claim:

1. A control method for controlling operation of a crane having a trolley driving apparatus for moving a trolley which has a rope for suspending and moving a load so as to reduce swinging of the load suspended by the rope, comprising the steps of:

obtaining an actual motor load torque signal based on output of a torque controller of the trolley driving apparatus wherein the torque controller drives a motor of a trolley drive system operating to move the trolley in response to an actual speed command signal applied to the trolley driving apparatus;

computing an estimated motor load torque signal for operating the motor to move the trolley which does not include load torque fluctuations caused by swinging of the rope, the computing of the estimated motor load torque signal being based on gain coefficients and equivalent time constants of the torque controller and the trolley drive system;

producing a feedback speed command signal based on a difference between the actual motor load torque signal and the estimated motor load torque signal, and on a set swing angle, the difference being representative of an estimated swing angle; and negatively feeding back to a trolley speed command, for controlling the trolley driving apparatus, the feedback speed command signal to produce the actual speed command signal applied to the trolley driving apparatus to thereby reduce a swing angle of the rope to the set swing angle.

2. The method according to claim 1, wherein producing the feedback speed command signal includes:

applying phase lead/lag compensation to a swing error based on the difference between the actual motor load torque signal and the estimated motor load torque signal and on the set swing angle; and applying a loop gain adjusted to a value proportional to a rope length of the rope, raised to the power of ½, to the difference between the actual motor load torque signal and the estimated motor load torque signal, and to the swing error.

3. The method according to claim 1 wherein producing the feedback speed command signal includes:

applying phase lead/lag compensation to a swing error based on the difference between the actual motor load torque signal and the estimated motor load torque signal and on the set swing angle; and applying a loop gain to the difference between the actual motor load torque signal and the estimated motor load torque signal, and to the swing error;

measuring a load size during a hoisting operation; and increasing the loop gain in inverse proportion to a reduction in the load size.

4. The control method of claim 1 wherein said step of producing the feedback speed command signal includes applying phase lead/lag compensation to a swing error based on the difference between the actual motor load torque signal and the estimated motor load torque signal and on the set swing angle.

5. The control method of claim 1 wherein said step of producing the feedback speed command signal includes:

determining an estimated swing load current $I_{2W}^*$ using $$I_{2W}^* = \frac{1}{K_T}(\tau_M - \tau_M^*)$$

where:

$\tau_M$=the actual motor load torque signal;

$\tau_M^*$=the estimated motor load torque signal; and $K_T$=a torque constant;

determining an estimated swing angle $\theta_1^*$ using $$\theta_1^* = I_{2W}^* \cdot K_D$$

where $K_D$ is a conversion coefficient;

determining a swing error $\Delta\theta$ using $$\Delta\theta = \theta_1^* - \theta_S$$

where $\theta_s$ is the set swing angle; and producing the feedback speed command signal by amplifying and applying phase lead/lag compensation to the swing error $\Delta\theta$.

6. The control method of claim 5 further comprising:

measuring a load size during a hoisting operation; and inversely proportioning $K_D$ to the load size.

7. A rope steadying control apparatus for a crane comprising:

the crane having a trolley driving apparatus for moving a trolley which has a rope for suspending and moving a load;

the trolley driving apparatus having a torque controller and a trolley drive system with a motor controlled by the torque controller to move the trolley in response to an actual speed command signal applied to the trolley driving apparatus;

a torque signal estimator for producing an estimated motor load torque signal for moving the trolley which does not include load torque fluctuations caused by swinging of the rope and which is based on a torque model including gain coefficients and equivalent time constants of the torque controller and the trolley drive system;

means for converting an output of the torque controller into an actual motor load torque signal which includes load torque fluctuation caused by actual swinging of the rope;

means for producing a feedback speed command signal based on a difference between the actual motor load torque signal and the estimated motor load torque signal, and on a set swing angle, the difference being representative of an estimated swing angle; and means for negatively feeding back to a speed command, for controlling the trolley driving apparatus, the feedback speed command signal to produce the actual speed command signal applied to the trolley driving apparatus to thereby reduce a swing angle of the rope to the set swing angle.

8. The rope steadying control apparatus according to claim 7, wherein the means producing the feedback speed command signal includes a phase lead/lag compensator acting on a swing error based on the difference between the actual motor load torque signal and the estimated motor load torque signal and on the set swing angle, and the rope steadying control apparatus further comprising means for applying a loop gain adjusted to a value proportional to a rope length of the rope, raised to the power of ½, to the difference between the actual motor load torque signal and the estimated motor load torque signal, and to the swing error.

9. The rope steadying control apparatus according to claim 8, further comprising:

means for measuring a load size during a hoisting operation; and means for increasing the loop gain in inverse proportion to reduction in the load size.

10. The rope steadying control apparatus of claim 7 wherein said means for producing the feedback speed command signal includes a phase lead/lag compensator for processing a swing error based on the difference between the actual motor load torque signal and the estimated motor load torque signal and on the set swing angle.

11. The rope steadying control apparatus of claim 7 wherein said means for producing the feedback speed command signal includes:

means for determining an estimated swing load current $I_{2W}^*$ in accordance with $$I_{2W}^* = \frac{1}{K_T}(\tau_M - \tau_M^*),$$

where:

$\tau_M$=the actual motor load torque signal;

$\tau_M^*$=the estimated motor load torque signal; and $K_T$=a torque constant;

means for determining an estimated swing angle $\theta_1^*$ in accordance with $$\theta_1^* = I_{2W}^* \cdot K_D,$$

where $K_D$ is a conversion coefficient;

means for determining a swing error $\Delta\theta$ in accordance with $$\Delta\theta = \theta_1^* - \theta_s$$

where $\theta_s$ is the set swing angle; and processing means for producing the feedback speed command signal by amplifying and applying phase lead/lag compensation to the swing error $\Delta\theta$.

12. The rope steadying control apparatus of claim 11 further comprising:

measuring means for measuring a load size during a hoisting operation; and means for inversely proportioning $K_D$ to the load size.

* * * * *